US006371751B1

(12) United States Patent
Aneja et al.

(10) Patent No.: US 6,371,751 B1
(45) **Date of Patent: *Apr. 16, 2002**

(54) SPINNERETS WITH ORIFICES FOR IMPROVED FILAMENT CROSS-SECTIONS

(75) Inventors: Arun Pal Aneja; Robert Kenneth Roop, both of Greenville, NC (US)

(73) Assignee: E. I. du Pont de Nemours and Company, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/778,458

(22) Filed: Jan. 3, 1997

Related U.S. Application Data

(63) Continuation-in-part of application No. 08/662,804, filed on Jun. 12, 1996, now Pat. No. 5,736,243, which is a continuation-in-part of application No. 08/497,495, filed on Jun. 30, 1995, now Pat. No. 5,591,523, and a continuation-in-part of application No. 08/642,650, filed on May 3, 1996, now Pat. No. 5,626,961, which is a continuation-in-part of application No. 08/497,499, filed on Jun. 30, 1995, now abandoned.

(51) Int. Cl.[7] ..... D01D 4/00

(52) U.S. Cl. ..... 425/382.2; 264/177.13; 425/464

(58) Field of Search ..... 425/464, 465, 425/131.5, 192.5, 382.2; 264/172.11, 172.12, 172.13, 172.14, 172.17, 177.13, 177.15

(56) References Cited

U.S. PATENT DOCUMENTS

| | | | | | |
|---|---|---|---|---|---|
| 2,816,349 | A | | 12/1957 | Pamm et al. | 28/82 |
| 2,945,739 | A | | 7/1960 | Lehmicke | 18/54 |
| 3,156,607 | A | | 11/1964 | Strachan | 161/177 |
| 3,568,249 | A | * | 3/1971 | Matsui | 425/131.5 |
| 3,914,488 | A | | 10/1975 | Gorrafa | 428/397 |
| 4,182,606 | A | | 1/1980 | Gibbon | 425/461 |
| 4,316,924 | A | | 2/1982 | Minemura et al. | 428/89 |
| 4,332,761 | A | * | 6/1982 | Phillips et al. | 264/147 |
| 4,634,625 | A | | 1/1987 | Franklin | 428/258 |
| 4,707,407 | A | | 11/1987 | Clark et al. | 428/361 |
| 5,006,057 | A | * | 4/1991 | Bagrodia et al. | 425/464 |
| 5,176,926 | A | * | 1/1993 | Tung | 425/461 |
| 5,458,835 | A | * | 10/1995 | Wilkes et al. | 264/143 |

FOREIGN PATENT DOCUMENTS

| | | |
|---|---|---|
| JP | 4-119118 | 4/1992 |

* cited by examiner

*Primary Examiner*—Nam Nguyen
*Assistant Examiner*—Joseph Leyson

(57) ABSTRACT

Novel spinnerets for producing multi-grooved filaments have a row of apertures connected by slots that correspond to the grooves in the periphery of the resulting filaments.

5 Claims, 3 Drawing Sheets

SPINNERETS WITH ORIFICES FOR IMPROVED FILAMENT CROSS-SECTIONS

CROSS-REFERENCE TO RELATED APPLICATIONS

This is a continuation-in-part of application Ser. No. 08/662,804 filed on Jun. 12, 1996, now U.S. Pat. No. 5,736,243, which is a continuation-in-part of application Ser. No. 08/497,495 filed on Jun. 30, 1995, now U.S. Pat. No. 5,591,523, and a continuation-in-part of application Ser. No. 08/642,650 filed on May 3, 1996, now U.S. Pat. No. 5,626, 961, which is a continuation-in-part of U.S. Pat. No. 08/497, 499 filed on Jun. 30, 1995, now abandoned.

FIELD OF INVENTION

This invention relates to spinnerets with orifices for improved filament cross-sections, and more particularly for spinning filaments of improved cross-sections that have multiple longitudinal grooves in the periphery of the filament cross-sections.

BACKGROUND

Some 40 years ago, Pamm and Rogers disclosed in U.S. Pat. No. 2,816,349 that pill-resistant fabrics could be made from melt-spun synthetic staple of denier per filament no more than about 1.6 and a filament ratio (modification ratio) of at least about 5, suitable filaments being prepared by melt-spinning through an essentially slot-shaped orifice, having a width no greater than about 2 mils (50 microns), abruptly expanded tips and additional abrupt expansions separating every 10 to 20 mils (250 to 500 microns) of slot length, slots being substantially rectangular with length 5 or more times their width, and the expanded tips and additional abrupt expansions being preferably circular, but could be rectangular, square, diamond shaped or oval, provided that the longer dimensions of the non-circular embodiments be approximately perpendicular to the length of the slot. Lehmicke, in U.S. Pat. No. 2,945,739, disclosed essentially similar spinneret orifices and that such designs in the form of a Y, a T, a cross, a spiral and the like were possible. Their intention was to spin filaments of high filament ratio (modification ratio) such as having cross-sections of length to width ratio 5 or more.

Multi-lobed filaments have been described, e.g. by Strachan some 30 years ago in U.S. Pat. No. 3,156,607, Gorrafa some 20 years ago in U.S. Pat. No. 3,914,488, Franklin and Clark et al. some 10 years later in U.S. Pat. Nos. 4,634,625 and 4,707,407, respectively, and more recently Toray (Tsukamoto et al.) in Japanese Patent Application Kokai Hei 4-119118, published Apr. 20, 1992. Strachan disclosed filament cross-sections of essentially oval cross-section (A:B ratio 1.3 to 1.8) and having 6 to 8 lobes with tip radius ratios of 0.15 to 0.6 and interconnected by smooth continuous peripheral lines that were "free from abrupt changes of direction". Strachan spun his filaments from slotted orifices having configurations as shown in his FIG. 7 for 6 lobes, and in his FIG. 8 for 8 lobes, and the tip radius ratio was controlled by varying the width of the slots or by providing circular apertures at their extremities as shown in his FIG. 9. Toray (Japanese Hei 4-119118) disclosed a somewhat similar 8-lobed oval deformed cross-section for his filament in his FIG. 1, spun from a slotted spinneret orifice shown in his FIG. 2, in which a longer central vertical slot was provided in contrast to shorter vertical slots on either side; spinneret slot dimensions were not disclosed by Toray. Gorrafa, Franklin and Clark et al. all disclosed filaments having cross-sections that are now referred to as scalloped-oval cross-sections, A:B ratios being 1.4:1 to 2.4:1, with tip radius ratios being disclosed and 4 grooves also being disclosed. Gorrafa showed two spinneret orifice configurations: his FIG. 5 was used to spin his filaments of his Example 1, and the orifice comprised 3 diamond-shaped holes that were separated but closely-spaced to permit melt coalescence after extrusion; his FIG. 6 was used to spin his filaments of his Example 2, and these orifices comprised 3 round holes interconnected by 2 channels; Gorrafa disclosed his spinneret orifice dimensions in his Examples; his objective was to make pile fabrics from his filaments to simulate natural furs. Franklin claimed new woven fabrics with yarns that had been textured from partially-oriented feed yarns whose filaments had the scalloped-oval cross-section. Franklin used spinneret orifices as shown in his FIG. 2, said to be 3 diamond-shaped units joined by slots; spinneret orifice dimensions were not disclosed by Franklin. Clark's disclosure of spinneret orifices was similar to Franklin's, but Clark made water-dispersible fiber of short cut length.

About 15 years ago, Minemura et al. disclosed in U.S. Pat. No. 4,316,924 synthetic furs with guard hair-like raised synthetic fibers as disclosed in a Japanese Patent Publication No. 48-4910 of dpf 10 to 100 and having transverse cross-sections with at least one constricted part as shown, for example, in Minemura's FIGS. 1A to 1S, obtained by using spinnerets having orifices as shown in FIGS. 2A to 2S.

As indicated in the art, it has proved difficult in practice to design spinneret orifice configurations that provide filaments of fine dpf and having multiple grooves that extend along the length of the filaments and yet avoid processing problems, such as fibrillation, i.e., separation of the portions of the filaments by tearing along the groove during spinning or during later processing of the filaments. This is the problem that faced the present inventors and has been solved by them.

SUMMARY OF THE INVENTION

Accordingly, there is provided a spinneret for the production of multi-grooved filaments, comprising a plate having upper and lower surfaces connected by a capillary, said capillary being defined at the lower surface by a complex orifice that comprises a plurality of apertures, said apertures having flow areas (A), said apertures being located in a row, said apertures having widths (H) in a direction that is perpendicular to said row, and said apertures being interconnected by slots that are also located in said row, said slots having flow areas (a) and widths (h), said widths (h) also being in a direction that is perpendicular to said row, wherein sizes of flow areas A and a are such that the ratio a/A for an aperture and for a slot adjacent thereto is about 0.02:1 to about 0.2:1, and widths H and h are such that the ratio h/H for an aperture and for a slot adjacent thereto is about 0.05:1 to about 0.25:1.

The apertures should preferably not all be circular, but most should be of greater width than a circle, i.e., should extend away from the row of slots to a greater extent, and are preferably diamond-shaped, for instance as shown in FIGS. 1, 2 or 4 referred to herein, but may be of other non-round shapes, such as shown for example in FIG. 5 herein.

In preferred spinnerets, the width (H) of an aperture at an end of the row is less than the width (H) of an aperture between the ends of the row, especially such as to produce a multi-grooved filament of generally scalloped-oval periphery with multiple indentations, i.e., grooves in the periphery, such as may be obtained, for example, by spinning filaments from orifices as shown in FIG. 1 or FIG. 4.

DETAILED DESCRIPTION OF PREFERRED EMBODIMENTS

As indicated, this is a continuation-in-part of prior applications filed by Aneja. The disclosure of such prior applications is hereby specifically incorporated by reference, as is the disclosure of U.S. Pat. No. 5,834,119 filed by Rcop simultaneously herewith, as these applications disclose filaments and their cross-sections and spinnerets that may be used therefor. Much of the technology of spinnerets for spinning synthetic polymeric filaments is known and has been disclosed in art such as U.S. Pat. No. 5,487,859, the disclosure of which is hereby incorporated herein by reference, as is the literature references disclosed therein. The essence of the present invention is the shape of the complex capillary orifice in the lower surface (i.e., face) of the spinneret, so much of the disclosure hereinafter concentrates on this aspect and on the shape of the filaments that are desired to be spun therefrom.

As indicated in the "Background" hereinbefore, Gorrafa and others have previously described multi-lobed filaments that have cross-sections that have been referred to as "scalloped-oval". The "scallops" refer to the indentations in the peripheral cross-sections that correspond to the longitudinal grooves that extend along the filaments. Emphasis has been on the multilobed configuration in much of the published art, rather than on the indentations or grooves between such lobes. In contrast, according to the present invention, we lay emphasis on how to make improved grooves in filaments that may be processed without, for example, fibrillation by fracturing along such grooves.

According to the present invention, such multi-grooved filaments are spun from spinnerets having complex orifices of novel shape, being a row of apertures connected by slots, the flow areas and widths of the apertures and of adjoining slots being within defined ranges, as claimed.

The invention will be further described with reference to the accompanying drawings, all of which show bottom views (greatly magnified) of capillary orifices in the face of a spinneret.

Figure 1:
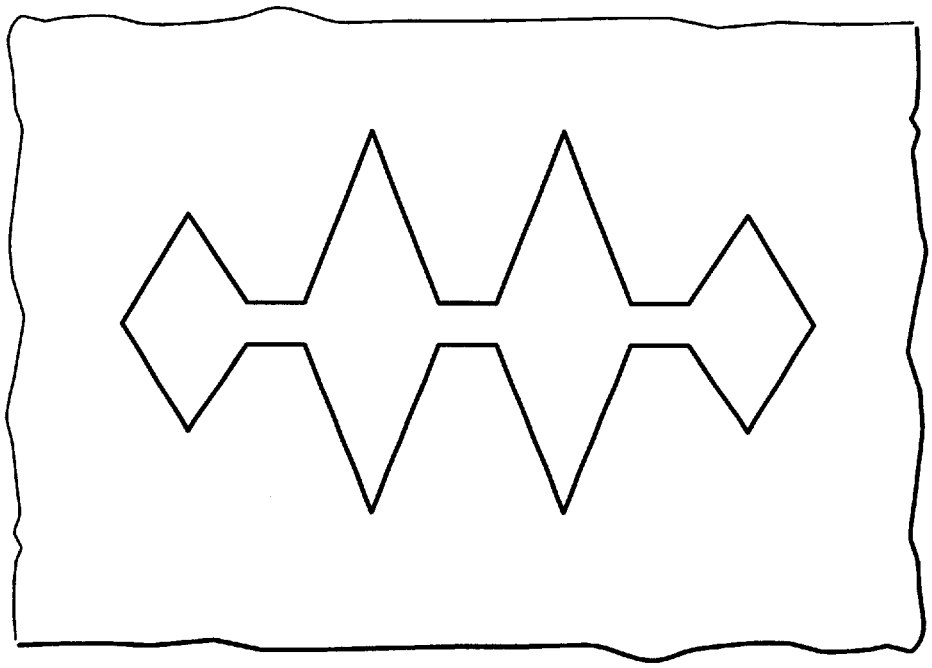
FIG. 1 is a magnified fragmentary bottom view of a spinneret according to the invention, showing 4 apertures and 3 connecting slots of a capillary orifice for spinning 6-grooved filaments.
Figure 3:
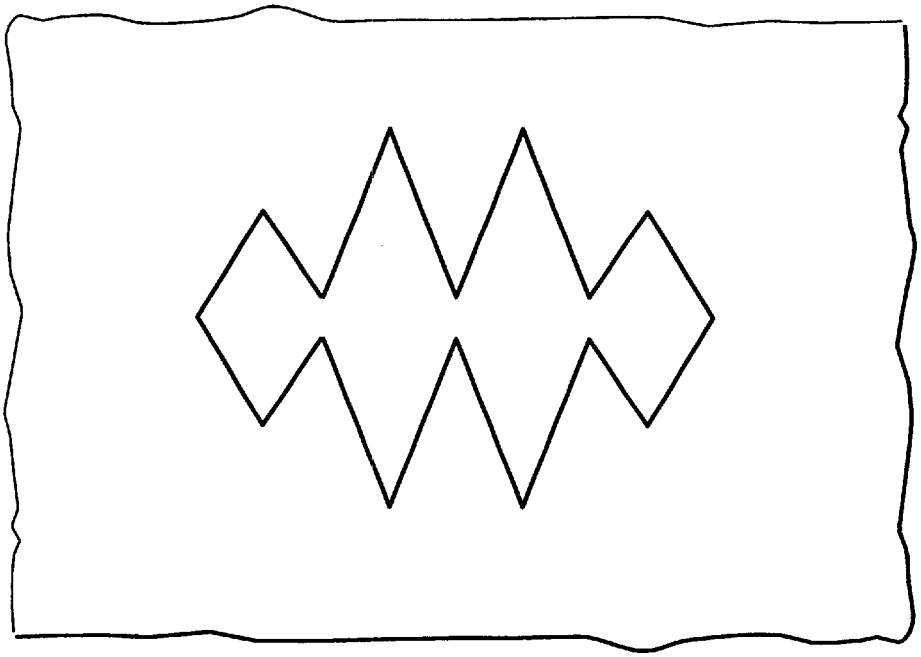
FIG. 3 is a magnified fragmentary bottom view of a spinneret that is not according to the invention, but having 4 apertures without connecting slots.

The orifice of FIG. 1 herein is shaped like that of FIG. 3 of U.S. Pat. No. 5,626,961 for spinning filaments of scalloped-oval cross-section with 6 grooves. All 4 apertures are diamond-shaped, the outer diamonds at each end being smaller than the inner diamonds, so as to provide a scalloped-oval shape, and the 4 diamonds do not intersect but are connected by 3 channels.

Figure 2:
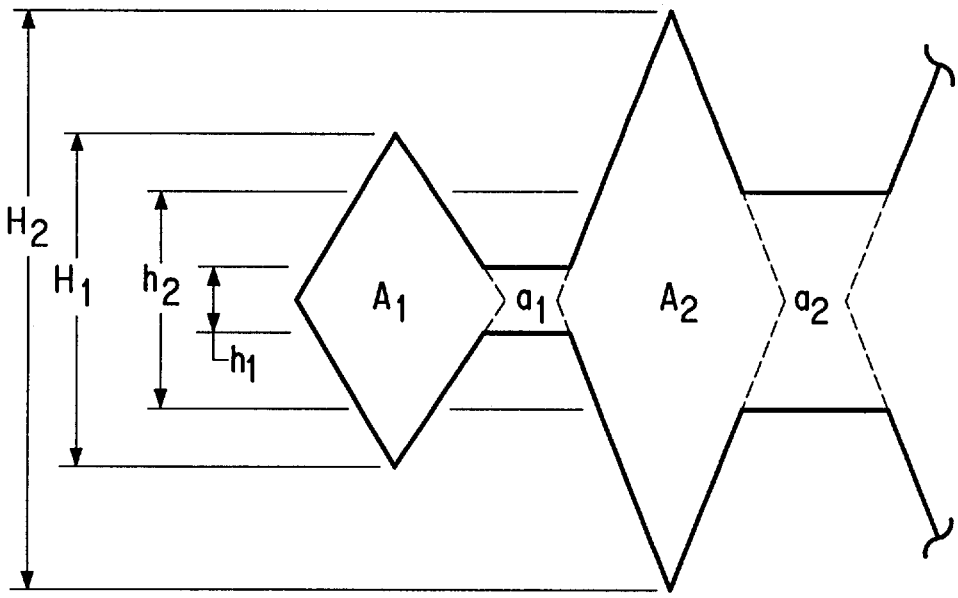
FIG. 2 is a partial view of an orifice somewhat like the left side of FIG. 1, showing how flow areas (A) and (a) are measured and calculated, and widths (H) of apertures and widths (h) of slots.

FIG. 2 shows part (left side) of an orifice somewhat like that in FIG. 1 being somewhat further magnified (over FIG. 1) to explain how the flow areas (A and a) and widths (H and h) are calculated or measured (along the face of the spinneret). The widths are measured in directions that are perpendicular to the row of slots and apertures, and are referred to in U.S. Pat. No. 5,626,961 as heights along the y-axis. The flow areas (A) of the diamond-shaped apertures are measured and calculated for the full diamond-shapes, i.e., these flow areas extend beyond the ends of each slot insofar as the sides of the diamonds are extrapolated until those sides meet within the slots. Correspondingly, the flow areas (a) of the slots are measured and calculated so as to exclude the entire diamond-shapes, as explained in the preceding sentence. On the basis of extensive work, we have determined, according to the invention, that the a/A ratios, such as $a_1/A_1$ and $a_1/A_2$ for the left-hand slot in relation to each adjacent diamond, are a key parameter and should be about 0.02:1 to about 0.2:1, and preferably about 0.05:1 to about 0.15:1, as higher ratios would diminish the depths of any grooves between the corresponding lobes of the resulting filament, whereas lower ratios would increase the danger of fibrillation and, similarly, the h/H ratios, such as $h_1/H_1$ and $h_1/H_2$ for this slot and for the adjacent apertures, are also a key parameter and should be about 0.05:1 to about 0.25:1, and preferably about 0.05:1 to about 0.2:1; we considered and experimented with several other parameters and determined that they are not as important as the a/A ratios and the h/H ratios.

The flow areas (A) and widths (H) of the apertures need not all be the same and, similarly, the flow areas (a) and widths (h) of the slots need not all be the same, as may be seen from the various Figures. Indeed, for spinning filaments of scalloped-oval cross-section, it is preferred to extrude more polymer through any central aperture and less through the outer apertures so as to obtain the desired generally oval periphery for the filament cross-section (with grooves). Although generally diamond-shaped apertures are preferred for spinning such filaments, other aperture shapes may be used as shown, for example in FIG. 5. It will be noted that these shapes mostly extend away from the row of slots, i.e., their widths (H) are greater than their lengths along the row. Circular shapes are not generally desirable, but may be combined with preferred shapes, as illustrated, for example, in FIG. 5 h, where circular apertures are located at the ends of the row. The number of slots and apertures will depend on the number of grooves desired, e.g. 2–10 apertures (correspondingly 1–9 slots), and preferably 2–6, it being understood that an odd number of slots will generally result in filaments having central grooves, whereas an even number of slots symmetrically-located can provide filaments of maximum width in the middle of the filament cross-section, there being a longitudinal groove on each side of each of the bulges that contribute to the maximum width of the filament.

FIG. 3 is similar to FIG. 1, in that the orifice has 4 diamond-shaped apertures. These diamonds are in a row without any slots therebetween, so the spinneret of FIG. 3 is not according to the invention. Filaments that have been spun from such a spinneret have been multi-lobal, but without deep grooves between lobes such as have been obtained by using spinnerets according to the invention.

Figure 4:
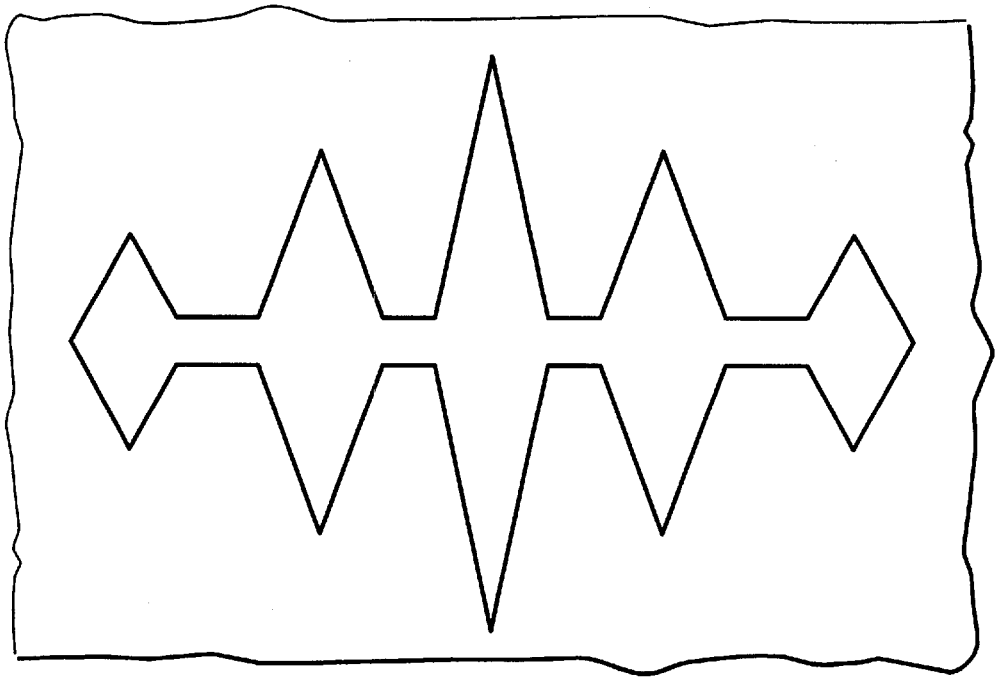
FIG. 4 is a magnified fragmentary bottom view of a spinneret according to the invention as for FIG. 1, but for spinning 8-grooved filaments.
Figure 5A:
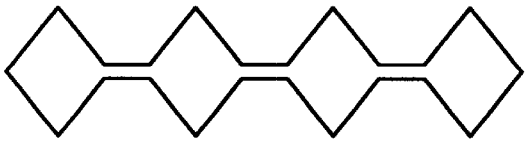
FIG. 5 shows schematic magnified representations of other spinneret orifices according to the invention with varying shapes for apertures.
Figure 5E:
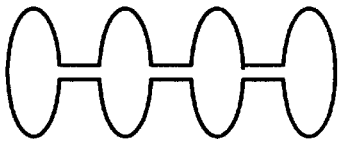
Figure 5B:
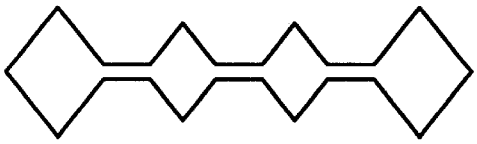
Figure 5F:
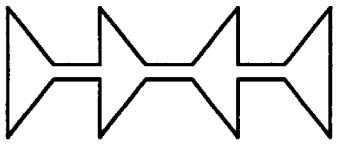
Figure 5C:
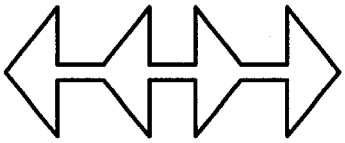
Figure 5G:
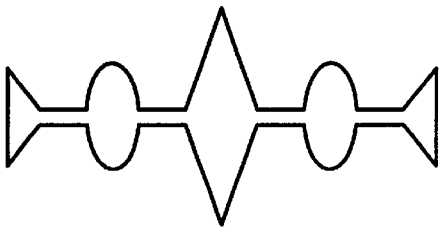
Figure 5D:
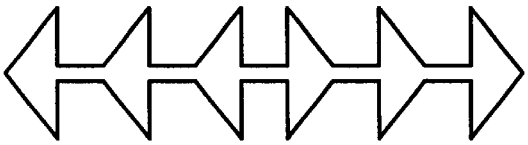
Figure 5H:
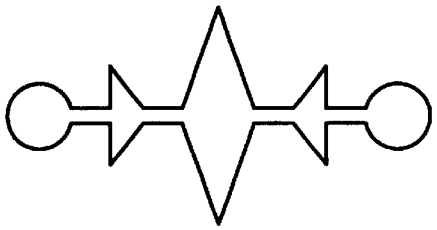

FIG. 4 is like FIG. 3 of application Ser. No. 08/778,462, now allowed, referred to above and having been filed Jan. 3, 1997, by Rcop simultaneously herewith.

FIG. 5 has already been discussed.

We claim:

1. A spinneret for the production of multi-grooved filaments, comprising a plate having upper and lower surfaces connected by a capillary, said capillary being defined at the lower surface by a complex orifice that comprises a plurality of apertures, said apertures having flow areas (A), said apertures being located in a row, said apertures having widths (H) in a direction that is perpendicular to said row, and said apertures being interconnected by slots that are also located in said row, said slots having flow areas (a) and widths (h), said widths (h) also being in a direction that is perpendicular to said row, wherein sizes of flow areas A and a are such that the ratio a/A for an aperture and for a slot adjacent thereto is about 0.05:1 to about 0.2:1, and widths H and h are such that the ratio h/H for an aperture and for a slot adjacent thereto is about 0.05:1 to about 0.25:1.

2. A spinneret as claimed in claim 1, comprising diamond-shaped apertures in said capillary orifice.

3. A spinneret as claimed in claim 1, wherein the width (H) of an aperture at an end of said row is less than the width (H) of an aperture between the ends of said row.

4. A spinneret as claimed in claim 1, wherein the slots are odd in number, resulting in filaments having central grooves.

5. A spinneret as claimed in claim 1, wherein the slots are even in number and symmetrically located, resulting in filaments of maximum width in the middle of the filament cross-section, there being a longitudinal groove on each side of each of the bulges that contribute to the maximum width of the filament.

* * * * *